US010537489B1

(12) United States Patent
Youn et al.

(10) Patent No.: US 10,537,489 B1
(45) Date of Patent: Jan. 21, 2020

(54) CRUTCH HAVING JOINT STRUCTURE

(71) Applicants: Hyundai Motor Company, Seoul (KR); Kia Motors Corporation, Seoul (KR)

(72) Inventors: Seok Young Youn, Seoul (KR); Joo Young Chun, Gyeonggi-do (KR); Kye Yoon Kim, Gyeonggi-do (KR); Ju Young Yoon, Gyeonggi-do (KR); Kyung Mo Jung, Gyeonggi-do (KR); Ji Min Han, Gyeonggi-do (KR); Sang In Park, Gyeonggi-do (KR); Dong Jin Hyun, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/207,684

(22) Filed: Dec. 3, 2018

(30) Foreign Application Priority Data

Aug. 8, 2018 (KR) ..... 10-2018-0092481

(51) Int. Cl.
*A61H 3/02* (2006.01)
*A61G 5/14* (2006.01)

(52) U.S. Cl.
CPC ..... *A61H 3/02* (2013.01); *A61G 5/14* (2013.01); *A61H 2003/0238* (2013.01)

(58) Field of Classification Search
CPC ..... A61H 3/02; A61G 5/14
USPC ..... 135/71, 73
See application file for complete search history.

(56) References Cited

U.S. PATENT DOCUMENTS 2,788,793 A * 4/1957 Abbott ..... A61H 3/02 135/68
5,329,954 A * 7/1994 Miyoshi ..... A61H 3/02 135/68
5,624,199 A * 4/1997 Cheng ..... A47D 13/063 403/100
5,771,910 A * 6/1998 Kluttz ..... A61H 3/02 135/68
7,712,479 B2 * 5/2010 Sundarrao ..... A45B 7/00 135/74
8,474,470 B2 * 7/2013 Albertyn ..... A61H 3/02 135/69
10,258,533 B1 * 4/2019 Chu ..... A61H 3/02
(Continued)

FOREIGN PATENT DOCUMENTS

EP 0149576 A2 * 7/1985 ..... A61H 3/02
EP 1410781 A1 * 4/2004 ..... A61H 3/02
(Continued)

*Primary Examiner* — David R Dunn
*Assistant Examiner* — Danielle Jackson
(74) *Attorney, Agent, or Firm* — Mintz Levin Cohn Ferris Glovsky and Popeo, P.C.; Peter F. Corless

(57) ABSTRACT

A crutch has a joint structure, and the crutch includes a stationary section supported on a floor at a lower end of the stationary section, and extending from a lower portion to an upper portion thereof; and a rotary section coupled to the stationary section so as to be rotatable relative to the stationary section with respect to a rotational axis provided at the upper portion of the stationary section. The rotary section is configured by coupling a hand grip part for supporting a wearer's hand in a state where the wearer wears the crutch and a forearm part supporting a forearm of the wearer.

6 Claims, 3 Drawing Sheets

(56) References Cited

U.S. PATENT DOCUMENTS

| | | | | |
|---|---|---|---|---|
| 2013/0098412 | A1* | 4/2013 | Weber | A45B 9/02 135/66 |
| 2013/0247946 | A1* | 9/2013 | Summit | A61H 3/02 135/69 |
| 2015/0144167 | A1* | 5/2015 | Brignone | A61H 3/02 135/71 |
| 2016/0287463 | A1* | 10/2016 | Yue | A61H 3/00 |
| 2016/0287464 | A1* | 10/2016 | Younger | A61H 3/02 |
| 2017/0128314 | A1* | 5/2017 | Dropsho | A61H 3/0288 |
| 2019/0008715 | A1* | 1/2019 | Younger | A61H 1/00 |

FOREIGN PATENT DOCUMENTS

| | | | | |
|---|---|---|---|---|
| EP | 3205227 | A1 * | 8/2017 | A45B 7/005 |
| JP | 3605769 | B1 | 12/2004 | |
| JP | 2007-508057 | A | 4/2007 | |
| JP | 2009-268655 | A | 11/2009 | |
| JP | 2013-154039 | A | 8/2013 | |
| JP | 2015-171409 | A | 10/2015 | |
| NL | 2000270 | C2 * | 4/2008 | A61H 3/02 |
| WO | 2005/037162 | A2 | 4/2005 | |
| WO | WO-2012027336 | A1 * | 3/2012 | A61H 3/00 |

* cited by examiner

CRUTCH HAVING JOINT STRUCTURE

CROSS REFERENCE TO RELATED APPLICATION

The present application claims under 35 U.S.C. § 119(a) the benefit of Korean Patent Application No. 10-2018-0092481 filed on Aug. 8, 2018, the entire contents of which are incorporated by reference herein.

BACKGROUND

(a) Technical Field

The present disclosure relates to a crutch having a joint structure, more particularly, to the crutch having the joint structure capable of being rotated when a wearer's posture is changed between a sitting posture and a standing posture.

(b) Description of the Related Art

A wearable assistance robot for assisting a lower body muscular strength has been developed, and is particularly helpful for persons who are injured or suffer from a disability, and the elderly. In conjunction with the wearable robot, a crutch which is operated synchronously with operation of the wearable robot has been developed.

A crutch is a device for assisting a user (wearer) with activities such as walking or the like, and the crutch supports the load of the wearer's shoulders and wrists to assist the wearer's lower body muscles. In particular, excessive load is concentrated on the shoulder and wrist when the wearer changes his/her posture from a sitting posture to a standing posture.

FIG. 1 (RELATED ART) is a view illustrating a change in posture of a wearer in a sequence of using a crutch according to the related art.

Referring to FIG. 1, a crutch A according to the related art is formed in a straight-line shape, and this crutch has a problem in that the entire load is concentrated on a shoulder and a wrist of a wearer using/wearing this crutch, and in particular, a large load is concentrated on the shoulder. Accordingly, there is a problem in that the wearer feels the large load on the shoulder and the wrist, and thus may experience extreme fatigue.

Since a length of the straight-line type crutch A is not varied when a wearer's posture is changed from the sitting posture to the standing posture, in addition, there is a problem in that a lower end portion, which is spaced apart from the center of gravity of the wearer in the sitting posture and an upper portion, is supported on a floor and thus the lower end portion of the crutch A may be slid on the floor.

Further, a hand grip part of the crutch A includes a manipulation part including an operation switch for controlling operation of the wearable robot which is operated in conjunction with the crutch A. However, a problem frequently occurs in which the wearer erroneously manipulates the manipulation part of the handle grip part when a posture is changed between the sitting posture and the standing posture, and therefore, a method for preventing such erroneous manipulation is needed.

It should be understood that the foregoing is intended merely to aid in the understanding of the background of the present disclosure, and is not intended to mean that the present disclosure falls within the purview of the related art that is already known to those skilled in the art.

SUMMARY

The present disclosure provides a crutch having a joint structure capable of being rotated when a wearer's posture is changed between a sitting posture and a standing posture, thereby reducing a load applied on the wearer's shoulder and enabling a stable posture change to be realized, when the posture is changed.

A crutch having a joint structure according to the present disclosure may include a stationary section supported on a floor at a lower end of the stationary section, and extending from a lower portion to an upper portion thereof; and a rotary section coupled to the stationary section so as to be rotatable relative to the stationary section with respect to a rotational axis provided at the upper portion of the stationary section. Here, the rotary section may be configured by coupling a hand grip part for supporting a wearer's hand in a state where the wearer wears the crutch and a forearm part supporting a forearm of the wearer.

The hand grip part may be coupled to a lower end portion of the forearm part so as to maintain a constant angle therebetween, and the rotational axis about which the rotary section is rotated relative to the stationary section may be formed at the lower end portion of the forearm part to which the end portion of the hand grip part is coupled.

The crutch having the joint structure according to the present disclosure may further include a locking mechanism configured to inhibit a relative rotation between the stationary section and the rotary section at a preset fixed angle at which an angle between the stationary section and the rotary section about the rotational axis corresponds to a state in which the wearer wears the crutch in a standing posture.

The locking mechanism may include a protrusion formed to be protruded outward from the stationary section and a through hole formed by penetrating the rotary section to correspond to a shape of the protrusion. Here, as the protrusion passes through the through hole, a relative rotation between the stationary section and the rotary section may be inhibited.

A support fixture may be formed on an upper side of the forearm part and extended to both sides of the wearer's forearm to partially surround the wearer's forearm.

The crutch having the joint structure according to the present disclosure may further include a manipulation part provided on the hand grip part for manipulating operation of wearable robot worn by the wearer, and the manipulation part may include a plurality of buttons including a button for manipulating a change in the posture between the standing posture and the sitting posture of the wearer.

The button manipulating a change in posture between the sitting posture and the standing posture of the wearer may be located at an outermost end portion of the hand grip part.

In the manipulation part, the buttons except for the button for manipulating a change in posture may be deactivated during the change in posture between the standing posture and the sitting posture of the wearer.

BRIEF DESCRIPTION OF THE DRAWINGS

The above and other objects, features and advantages of the present disclosure will be more clearly understood from the following detailed description taken in conjunction with the accompanying drawings, in which.

DESCRIPTION OF PREFERRED EMBODIMENTS

Figure 1:
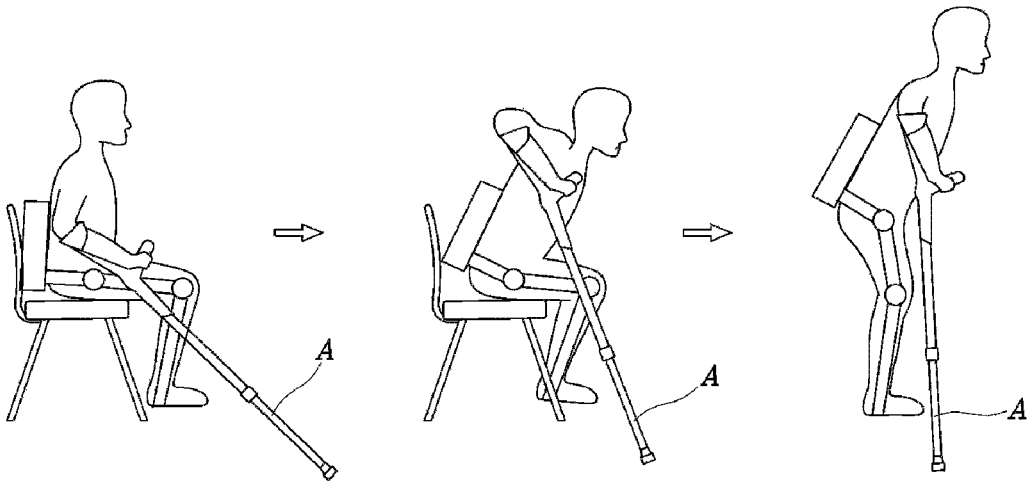
FIG. 1 (RELATED ART)
FIG. 1 (RELATED ART) is a view illustrating a change in posture of a wearer in a sequence of using a crutch according to the related art.

Specific structural and functional descriptions of the embodiments of the present disclosure disclosed in this specification or application are only for the purpose of illustrating embodiments according to the present disclosure, and the embodiments according to the present disclosure may be embodied in various forms and should not be interpreted as being limited to the embodiments described in this specification or the application.

While the present disclosure is susceptible to various modifications and may have a variety of embodiments, specific embodiments thereof will be illustrated by way of example in the drawings and described in detail in the detail description. It is to be understood, however, that the present disclosure is not intended to be limited to the particular embodiments, but includes all modifications, equivalents, and alternatives falling within the spirit and scope of the present disclosure.

The terms "first", "second", etc. may be used to describe various components, but the components should not be limited by those terms. The above terms are used merely for the purpose to distinguish a component from the other component. For example, a first component may be named a second component, and similarly, a second component may be named a first component without departing from the scope of right of the disclosure.

It should be understood that when any component is referred to as being "connected" or "coupled" to another component, the component may be directly connected or coupled to another component, but any intervening component may be present between these components. In contrast, it should be understood that when any component is referred to as being "directly connected" or "directly coupled" to another component, there is no intervening component between these components. Other expressions that describe a relation between the components, such as "between ~" and "directly between ~" or "adjacent to" and "directly adjacent to" should be interpreted as well.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Unless otherwise defined, all terms used herein, including technical or scientific terms, have the same meaning as those commonly understood by one of ordinary skill in the art to which the present disclosure pertains. Terms such as those defined in commonly used dictionaries should be interpreted as having a meaning consistent with the meaning in the context of the relevant art and, unless expressly defined in the present application, should not be interpreted as an ideal or overly formal sense.

Hereinafter, the present disclosure is described in detail by describing preferred embodiments of the present disclosure with reference to the accompanying drawings. Same reference numerals shown in the respective drawings indicate the same members.

Figure 2:
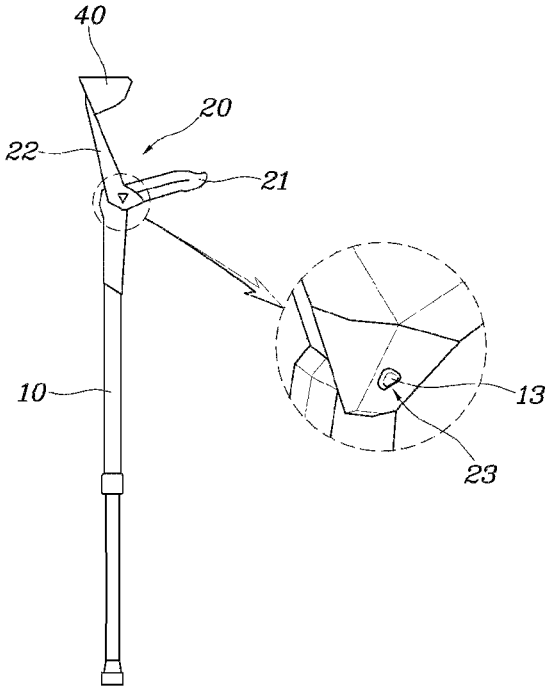
FIG. 2 is a view illustrating a crutch having a joint structure according to one embodiment of the present disclosure.
Figure 3:
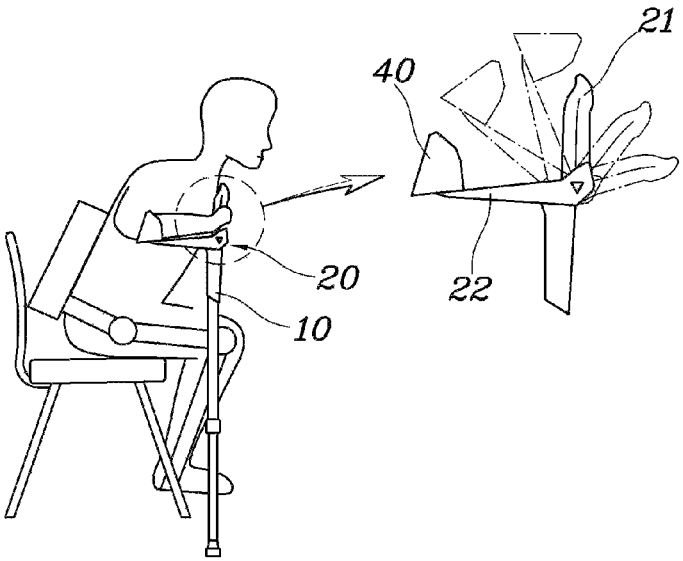
FIGS. 3 to 4 are views illustrating a sitting posture and a standing posture, respectively, of a wearer wearing the crutch having the joint structure according to one embodiment of the present disclosure.
Figure 4:
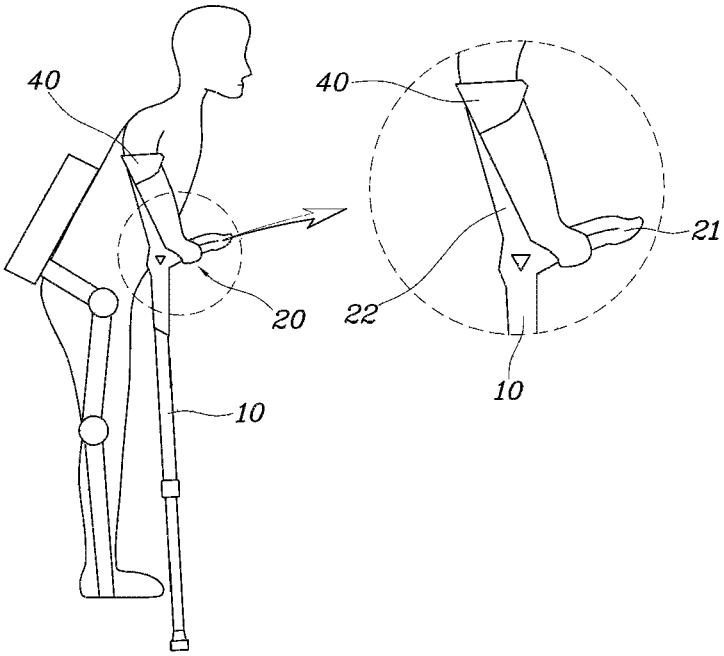

FIG. 2 is a view illustrating a crutch having a joint structure according to one embodiment of the present disclosure, and FIGS. 3 to 4 are views illustrating a sitting posture and a standing posture, respectively, of a wearer wearing the crutch having the joint structure according to one embodiment of the present disclosure.

Referring to FIGS. 2 to 4, a crutch having a joint structure according to one embodiment of the present disclosure includes a stationary section 10 supported on a floor at a lower end of the stationary section 10 and extending from a lower portion to an upper portion thereof, and a rotary section 20 coupled to the stationary section 10 so as to be rotatable relative to the stationary section with respect to a rotational axis provided at the upper portion of the stationary section 10. In particular, the rotary section 20 is configured by coupling a hand grip part 21 for supporting a wearer's hand in a state where a wearer wears the crutch and a forearm part 22 supporting a forearm of the wearer.

The stationary section 10 is a member extending in a longitudinal direction, and the lower end of the stationary section is supported on the floor and may be extended upward. It is preferably that the lower end of the stationary section is made of a material such as rubber or the like so as minimize slip.

The rotary section 20 may be coupled to the upper portion of the stationary section 10 so as to be relatively rotatable with respect to the rotational axis. In particular, the rotary section 20 is configured by coupling the hand grip part 21 for supporting the hand of the wearer in a state where the wearer wears the crutch and the forearm part 22 supports the wearer's forearm.

The hand grip part 21 may be formed in a rod shape to allow the wearer to grip it with a hand, and the forearm part 22 may be formed in a shape to support the wearer's forearm on the outside and a bottom the wearer's forearm.

A height of a wearer's shoulder and an angle of the forearm of the wearer in the sitting posture differ from those of the wearer in the standing posture, and the crutch having the joint structure is adjustable in order to compensate for the difference of each of the height of shoulder and the angle of forearm.

In other words, the rotary section 20 is relatively-rotatably coupled to the stationary section 10, which is supported at its lower end portion on the floor, so that the rotary section may be relatively rotated with respect to the rotational axis provided at the upper portion of the stationary section 10 when the wearer changes a posture between the sitting posture and the standing posture. Therefore, there are effects that the lower end portion of the stationary section 10 can be stably supported on the floor and the wearer can distribute the load over the forearm between a wrist and an elbow to reduce an intensive load applied to a shoulder, a wrist or the like.

The hand grip part 21 is coupled to a lower end portion of the forearm part 22 (i.e., at its end portion) so as to maintain a constant angle therebetween, and the rotational axis about which the rotary section 20 is rotated relative to the stationary section 10 may be formed at the lower end portion of the forearm part 22 to which the end portion of the hand grip part 21 is coupled.

The hand grip part 21 and the forearm part 22 may be coupled to each other so as to maintain a constant angle therebetween. It is desirable that the above constant angle is ergonomically designed so as to minimize the sense of heterogeneity that the wearer feels, and the hand grip part 21 gripped by the wearer's hand will maintain an angle close to 90° with the forearm part 22 supporting the wearer's forearm.

The rotational axis about which the rotary section 20 is rotated relative to the stationary section 10 is located at the lower end portion of the forearm part 22, and one end portion of the hand grip part 21 may be coupled to the lower end portion of the forearm part 22. The other end portion of the hand grip part 21 may be opened. Accordingly, even when the rotary section 20 is rotated relative to the stationary section 10 about the rotational axis, a rotational angle of the hand grip part 21 supporting the wearer's hand is coincident with that of the forearm part 22 supporting the wearer's forearm, so that it is possible to minimize the sense of heterogeneity that the wearer feels.

Referring specifically to FIG. 2, the crutch may further include a locking mechanism configured to inhibit a relative rotation between the stationary section 10 and the rotary section 20 at a preset fixed angle at which an angle between the stationary section 10 and the rotary section 20 about the rotational axis corresponds to a state in which the wearer wears the crutch in the standing posture.

The locking mechanism includes a protrusion 13 formed to be protruded outward from the stationary section 10 and a through hole formed by penetrating the rotary section 20 to correspond to a shape of the protrusion 13, such that as the protrusion 13 passes through the through hole 23, a relative rotation between the stationary section 10 and the rotary section 20 can be inhibited. It will be preferable that the protrusion 13 and the through hole 23 are located on the rotational axis between the stationary section 10 and the rotary section 20.

Specifically, the protrusion 13 formed to be protruded outward of the stationary section 10 may be inserted into the stationary section 10 and may include an elastic member therein that is capable of providing an elastic force by which the protrusion 13 is protruded outward of the stationary section 10. The protrusion 13 may be formed in a column shape having a triangular cross section as illustrated in the drawing, or may be formed to have various shapes depending on an angle allowing a relative rotation between the stationary section 10 and the rotary section 20.

At the preset fixed angle at which an angle between the stationary section 10 and the rotary section 20 about the rotational axis corresponds to a state in which the wearer wears the crutch in the standing posture, the protrusion 13 is protruded outward of the stationary section 10 and passes through the through hole 23, and it is thus possible to inhibit a relative rotation between the stationary section 10 and the rotary section 20.

When changing a wearer's own posture from the standing posture to the sitting posture, the wearer pushes the protrusion 13 into the stationary section 10 to release a fixing state between the stationary section 10 and the rotary section 20, and thus the relative rotation between the stationary section 10 and the rotary section 20 may be allowed.

In addition, when the posture of the wearer is completed in the standing posture, the protrusion 13 is automatically protruded outward by the elastic force and is fastened to the through hole 23 so as to fix the stationary section 10 and the rotary section 20, so that the wearer can directly enter an ambulation state without any separate manipulation.

Accordingly, the relative rotation between the stationary section 10 and the rotary section 20 can be prevented from occurring during a motion of the wearer, such as an ambulation in a standing posture, so that there is the effect that the stability can be ensured.

Additionally, the crutch may include a device for locking the relative rotation between the stationary section 10 and the rotary section 20 when the wearer is in the sitting posture. That is, by appropriately selecting the shapes of the protrusion 13 and the through hole 23, the relative rotation between the stationary section 10 and the rotary section 20 can be locked by a single locking mechanism at a plurality of angles.

For the sake of safety of the change in posture, a device, which allows the rotary section 20 to be rotated with respect to the stationary section 10 only in a corresponding direction and inhibits a rotation of the rotary section with respect to the stationary section in the opposite direction when the wearer changes the posture from the sitting posture to the standing posture and from the standing posture to the sitting posture, respectively, may be additionally provided.

In addition, as the wearer inputs a posture change using a controller manipulated by a manipulation part 30 (described later) by applying a manipulation force to the relative rotation between the stationary section 10 and the rotary section 20, it is possible to support the relative rotation caused by the change in wearer's posture and to control the relative rotation in the opposite direction to be blocked.

A support fixture 40 that is extended to both sides of the wearer's forearm to partially surround the wearer's forearm may be formed on an upper side of the forearm part 22. Since the forearm part 22 is a configuration corresponding to the forearm between a wrist and an elbow of the wearer and should support the wearer's load, in order to stably support the wearer's load, the support fixture 40 that is extended to both sides of the wearer's forearm to partially surround the wearer's forearm may be formed.

The support fixture 40 may be formed on the upper side of the forearm part 22 adjacent to the wearer's elbow to maximally stably support the forearm adjacent to the wearer's elbow that receives a large load when the posture is changed.

Figure 5:
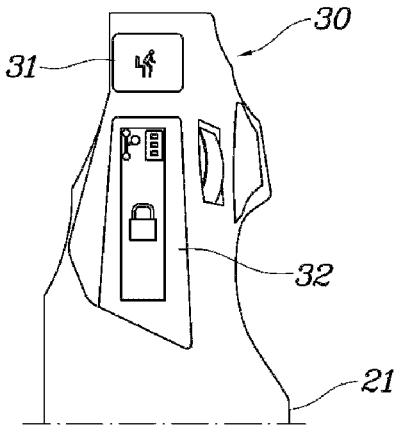
FIG. 5 is a view illustrating a manipulation part included in the crutch having the joint structure according to one embodiment of the present disclosure.

FIG. 5 is a view illustrating the manipulation part included in the crutch having the joint structure according to one embodiment of the present disclosure.

Even though the wearer may wear only the crutch to obtain an ambulation assistance, when the wearer wears a wearable robot, the crutch may include a controller for operation of the wearable robot and serve to assist dispersion of the load.

Referring to FIG. 5, the crutch having the joint structure according to one embodiment of the present disclosure may further include the manipulation part 30 provided on the hand grip part 21 and manipulating operation of a wearable robot worn by the wearer.

The manipulation part 30 is provided on the hand grip part 21 of the crutch having the joint structure to have a function of being able to easily manipulate operation of the wearable robot in a state where the wearer grips the hand grip part 21. The manipulation parts 30 may be formed on both of the crutches, respectively, but manipulation may be formed only on the left crutch having a relatively small supporting force.

The manipulation part 30 may include a plurality of buttons including a button 31 for manipulating a change in the posture between the standing posture and the sitting posture of the wearer and may include a display 32 showing a manipulation status. In addition to the above, the plurality of buttons may include buttons such as a mode changing button for changing the wearer's ambulation mode, a leg gathering button, a forward movement button and the like, and may further include a wheel that can be easily manipulated by the wearer. The buttons and the wheel may be appropriately arranged so as to be able to be manipulated by the wearer's thumb or forefinger in consideration of use or frequency.

The button 31 manipulating a change in posture between the standing posture and the sitting posture of the wearer may be located at an outermost end portion of the hand grip part 21. In other words, the button 31 for manipulating the change in posture between the standing posture and the sitting posture of the wearer may be located at the outermost end portion of the hand grip part 21 so that the wearer can manipulate this button by moving the thumb or forefinger in that, in comparison with the ambulation and the like, the change in posture between the standing posture and the sitting posture of the wearer is a relatively unusual manipulation and is an action of applying a large load to the hand grip part 21.

In the manipulation part 30, in addition, the buttons except for the button 31 for manipulating a change in posture may be deactivated during the change in posture between the standing posture and the sitting posture of the wearer. The change in posture between the standing posture and the sitting posture of the wearer is an operation in which a large load is particularly applied to the hand grip part 21, and therefore there is a high possibility that the wearer erroneously manipulates the manipulation part 30. Also, manipulation of the buttons can be deactivated during a change in posture in that since there is little need to control the ambulation during a change in posture.

Deactivating a manipulation of the button includes both the case in which the button itself is locked and the operation itself is impossible and the case in which the manipulation part 30 is controlled so as not to recognize the manipulation of the wearer even if the button is manipulated.

However, it is preferable to control the manipulation part so that the button 31 is not deactivated in that it is necessary to manipulate this button for manipulating the change in posture during the change in posture of the wearer. The button 31 for manipulating the change in posture is located at the outermost end portion of the hand grip part 21 so that the wearer can move the thumb or the forefinger to manipulate the button, and thus the possibility of erroneous manipulation can be minimized.

The crutch having the joint structure according to the present disclosure has the effect that the lower end portion of the stationary section can be stably supported on the floor and the wearer disperses the load over the forearm between the wrist and the elbow.

Accordingly, the crutch having the joint structure according to the present disclosure has the effect that the change in posture of the wearer is stably supported and the load on the wearer's shoulder and wrist is minimized.

Although the specific embodiments of the present disclosure have been illustrated and described, it will be apparent to those skilled in the art that the present disclosure may be variously modified and changed without departing from the technical spirit of the present disclosure as disclosed in the accompanying claims.

What is claimed is:

1. A crutch having a joint structure, the crutch comprising a stationary section supported on a floor at a lower end of the stationary section, and extending from a lower portion to an upper portion thereof; and a rotary section coupled to the stationary section so as to be rotatable relative to the stationary section with respect to a rotational axis provided at the upper portion of the stationary section, wherein the rotary section is configured by coupling a hand grip part for supporting a wearer's hand in a state where the wearer wears the crutch and a forearm part supporting a forearm of the wearer, further including a locking mechanism configured to inhibit a relative rotation between the stationary section and the rotary section at a preset fixed angle corresponding to a state in which the wearer wears the crutch in a standing posture, wherein the locking mechanism comprises a protrusion formed to be protruded outward from the stationary section and a through hole formed by penetrating the rotary section to correspond to a shape of the protrusion, such that as the protrusion passes through the through hole, a relative rotation between the stationary section and the rotary section is inhibited, and wherein the protrusion and the through hole are located on the rotational axis between the stationary section and the rotary section, and the protrusion is formed in a column shape having a triangular cross section.

2. The crutch of claim 1, wherein:

the hand grip part is coupled to a lower end portion of the forearm part so as to maintain a constant angle therebetween, and the rotational axis about which the rotary section is rotated relative to the stationary section is formed at the lower end portion of the forearm part to which an end portion of the hand grip part is coupled.

3. The crutch of claim 1, further comprising a support fixture formed on an upper side of the forearm part and extended to both sides of the wearer's forearm to partially surround the wearer's forearm.

4. The crutch of claim 1, further comprising:

a manipulation part provided on the hand grip part for manipulating operation of a wearable robot worn by the wearer, wherein the manipulation part comprises a plurality of buttons including a button for manipulating a change in posture between a standing posture and a sitting posture of the wearer.

5. The crutch of claim 4, wherein the button manipulating the change in posture between the sitting posture and the standing posture of the wearer is located at an outermost end portion of the hand grip part.

6. The crutch of claim 4, wherein, in the manipulation part, the buttons except for the button for manipulating the change in posture are deactivated during the change in posture between the standing posture and the sitting posture of the wearer.

* * * * *